US005649440A

United States Patent [19]

Arnautu et al.

[11] Patent Number: 5,649,440

[45] Date of Patent: Jul. 22, 1997

[54] METHOD FOR CALIBRATION OF ASSEL ROLLERS

[75] Inventors: Gheorghe Arnautu, Düsseldorf; Karl Heinz Häusler, Korschenbroich; Jürgen Pietsch; Gunther Voswinckel, both of Mönchengladbach; Karl-Helmut Wengenroth, Aachen, all of Germany

[73] Assignee: Mannesmann Aktiengesellschaft, Dusseldorf, Germany

[21] Appl. No.: 560,107

[22] Filed: Nov. 17, 1995

[30] Foreign Application Priority Data

Nov. 17, 1994 [DE] Germany ..... 44 42 198.2
Aug. 31, 1995 [EP] European Pat. Off. ..... 95 250 214

[51] Int. Cl.[6] ..... B21B 19/06

[52] U.S. Cl. ..... 72/96

[58] Field of Search ..... 72/96, 97, 98, 72/100

[56] References Cited

U.S. PATENT DOCUMENTS 2,060,768 11/1936 Assel ..... 72/96
3,719,066 3/1973 Okamoto et al. ..... 72/97

FOREIGN PATENT DOCUMENTS 4-135004 5/1992 Japan ..... 72/96

*Primary Examiner*—Lowell A. Larson
*Attorney, Agent, or Firm*—Cohen, Pontani, Lieberman, Pavane

[57] ABSTRACT

A method of calibrating and orienting forming rollers of an Assel-type rolling mill, and more particularly, of calibrating an Assel mill for rolling thin-walled tubes of pre-pierced hollow bodies about a mandrel, using at least three generally conical rollers that are circumferentially spaced about the mandrel. The orientation of each forming roller is adjusted so as to position the roller inclination relative to the mandrel axis of roll by an expansion angle α of approximately 7° to 30°. Each forming roller is also adjustably oriented so that its smoothing part relative to the mandrel axis of roll defines a transport angle γ of approximately 7° to 17°. In further accordance with this invention, each forming roller is configured so as to have an opening angle β of approximately 4° to 15°.

1 Claim, 1 Drawing Sheet

METHOD FOR CALIBRATION OF ASSEL ROLLERS

BACKGROUND OF THE INVENTION

1. Field of the Invention

The present invention relates to a method of calibrating the forming rollers of an Assel-type rolling mill and, more particularly, to a method of calibrating an Assel mill for rolling thin-walled tubes of pre-pierced hollow bodies about a mandrel using at least three generally conical rollers which are circumferentially spaced about the mandrel.

2. Description of the Prior Art

The Assel rolling method, developed some 60 years ago by Walter Assel, is particularly well suited for producing or forming roller bearing tubes and thick-walled turned part tubes having a diameter to wall thickness ratio of approximately 16:1. The Assel rolling method has over time been further developed through permanent improvements into a powerful stretching method. The Assel method is used in the manufacture of tubes having medium and strong wall thickness and, in particular, tubes requiring flawless surfaces and close tolerances, as for example roller bearing steel tubes. An Assel mill operates according to the principle of piercing around mandrel bars, employing three generally conical rollers that are mounted circumferentially about a mandrel bar so as to be inclined relative to the rolling axis of the mandrel. The three rollers are also circumferentially staggered or spaced apart relative to one another by approximately 120°. Furthermore, the rollers are vertically adjustable relative to their axis of rotation or roll so that a plurality of tube diameters can be produced on one Assel mill.

A forming roller of an Assel mill consists essentially of a conical entrance, a working shoulder, a smoothing part and a rounding part; the major forming work is carried out by the working shoulder of the roller. By using at least three generally conical forming rollers, the Assel method advantageously guides the rolling material and obviates the need for separate rolling material guide disks such, for example, as are required for the known Diescher process which uses two so-called arched rollers. The substantially smaller roll diameter of an Assel mill means that these mills can generally be notably smaller in size than corresponding Diescher rolling mills.

Like other known piercing methods, the Assel rolling method may permit the development of wall thickness irregularities that run in a helical line on the hollow ingot or tube and are known as "spirals." In a cross-section of the hollow body, these spirals act as an eccentricity, i.e. a deviation of the center points of the inner and outer circumferences relative to one another. In a longitudinal section of the hollow body, the spirals act as periodic and alternating thick and thin parts of the wall. Inadequate calibration of the forming rollers is the main cause of spiral formation on the hollow ingot or tube. For this reason, even though an Assel mill can maintain the strict wall thickness tolerances of ±4% to ±7% required for relatively thick wall tubes, tolerances in the case of thin wall tubes still leave much to be desired.

Another disadvantage of the Assel rolling method, as compared to other piercing processes, is the relatively low possible rolling speed, which restricts the capacity of the mill. The limits on rolling speed are formed by the maximum possible speed of the rolling material itself as well as the maximum possible transport angle. Too high a rolling material speed may lead to damage of the rolled tube, while too great a transport angle leads, in conventional roller calibration, to large spiral formation, i.e. poorer tube tolerances. Because it has not heretofore been and is not currently possible to significantly increase the speed of the rolling material and because the transport angle has been limited for acceptable resulting tolerance to approximately 7°, there has been no available known way to achieve further increases in rolling material speed. However, consideration was never given to the fact that, as discovered by applicant, the slope level of the bulge running in spiral fashion around the tube depends not only on the transport angle of the rollers but, also, on the tube diameter. The larger the tube diameter at the same transport angle, the larger the slope level of the spiral and the larger the difference between the thinnest and thickest portions of the walls. As a matter of principle, this also means that when tube diameters are small it is quite possible to roll with larger transport angles than previously possible if, for example, the slope level of the spiral is taken as a constant value. Furthermore, until now it has been possible to use the Assel method for only a limited purpose, namely, to achieve a maximum diameter/wall thickness ratio of approximately 12:1 to 16:1; in other words for thick-walled roller bearing tubes, turned part tubes, and the like. If larger diameter wall thickness ratios were selected, a triangulation effect occurred at the rear end of the tube which caused plugs as the tube left the forming rollers. This could only be prevented by timely ventilation of the forming rollers at the forming roller end.

If the Assel rolling method could also be successfully used to roll thin-walled tubes while maintaining acceptable surface and wall thickness tolerances, then the applications for this method could be broadened to include, for example, oil field tubes, boiler tubes and conduit tubes. The advantages of the Assel method compared, for example, to the Diescher rolling process could then be exploited. These advantages include good rolling material guidance by means of at least three rollers, good wall thickness tolerances in the tubes, low total investment costs and—because of the lower stress on the tubes in the rolling gap—better tube quality than in the Dieschef rolling process.

SUMMARY OF THE INVENTION

It is accordingly the desideratum of the present invention to permit suitable calibration and operative orientation of Assel forming rollers and thereby increase the capacity of Assel rolling units for rolling thin-walled tubes without negatively impacting tube quality.

To attain this object, a forming roller (one of at least three) is oriented relative to a mandrel axis of roll by a transport angle $\gamma$. Depending on the particular tube diameter and the length of the smoothing part, the transport angle is adjusted to between approximately 7° and 17° and decreases as the tube diameter increases. Each forming roller is also inclined relative to the mandrel axis of roll by an expansion angle $\alpha$ adjusted to between approximately 7° and 30°. Each forming roller is also constructed or configured so that its rounding part has an opening angle $\beta$, which is the angle between a mantle line extended from the peripheral surface of the smoothing part and a mantle line extended from the peripheral surface of the rounding part. The opening angle $\beta$ is set to between approximately 4° and 15°.

Attainment of the object of the invention includes a combination of these orientations and adjustments and settings. The appropriate transport angle $\gamma$ is dependent on the tube diameter at the smoothing part and the length of the smoothing part of the forming roller. Since it is known that a long smoothing part is disadvantageous and will hinder longitudinal stretching or elongation of the tube in the rolling process, the transport angle $\gamma$ should be decreased as the tube diameter increases. Furthermore, as the transport angle $\gamma$ increases, so too does the opening angle $\gamma$. Experience has also shown that a large transport angle $\gamma$ favors expansion of the tube in the roller gap. This effect is deliberately exploited by the present invention to produce larger tube diameters at the same wall thickness, i.e. Wilt a greater diameter/wall thickness ratio.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not intended as being drawn to scale.

DETAILED DESCRIPTION OF THE PRESENTLY PREFERRED EMBODIMENT

Figure 1:
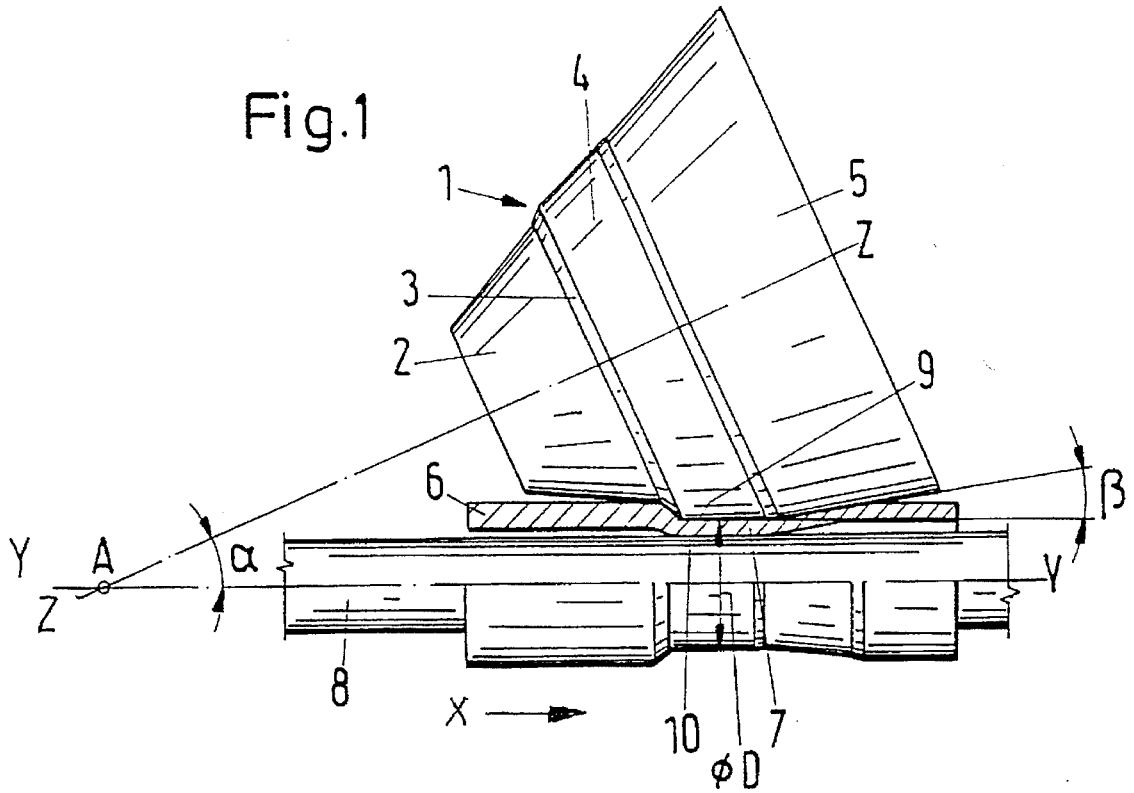
FIG. 1 is a longitudinal view of one of three Assel-type forming rollers constructed and oriented in accordance with the present invention.

Referring now to the drawings, and initially to FIG. 1 thereof, a forming roller 1 constructed and oriented in accordance with the present invention is shown. Also depicted is a mandrel 8 which is rotatable about a mandrel axis Y—Y and about which a hollow tube or ingot 6 is disposed for working or longitudinal elongation using the Assel rolling process. A generally conical forming roller 1—which is one of at least three such rollers circumferentially spaced about the mandrel and support tube—is configured to include a conical entrance 2, a working shoulder 3, a smoothing part 4 and a rounding part 5. Each forming roller 1 is rotatable about its respective forming roller axis Z—Z which intersects the mandrel axis Y—Y at point A and which is oriented relative to the mandrel axis Y—Y by an expansion angle $\alpha$. An opening angle $\gamma$ is defined between an extended mantle line of the circumferential peripheral smoothing part 4 and an extended mantle line of the circumferential peripheral rounding part 5 of each roller 1.

Figure 2:
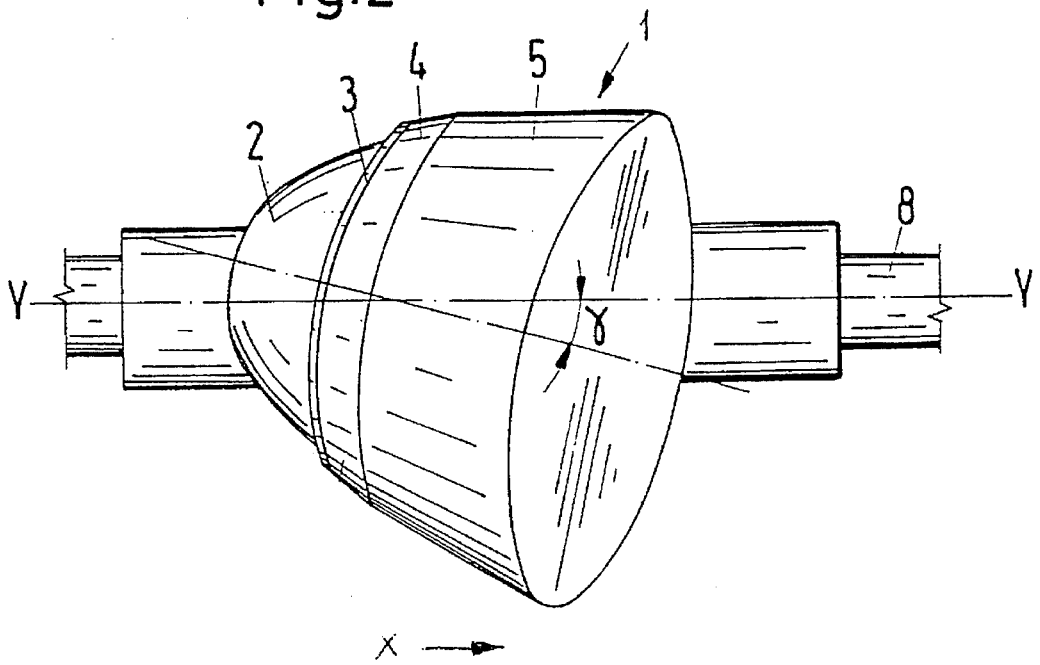
FIG. 2 is a top view of the forming roller of FIG. 1.

Referring now to FIG. 2, each forming roller 1 is also adjustably oriented relative to the mandrel axis Y—Y by a transport angle 7. The transport angle $\gamma$ of forming roller 1 facilitates the spiral-type forward movement of the tube or ingot 6 (FIG. 1) being worked and directly influences the rolling speed of the ingot 6. Proper selection of the transport angle $\gamma$ depends on the tube diameter $\phi D$ at smoothing part 4 of the forming roller 1; the appropriate transport angle $\gamma$ decreases as the tube diameter $\phi D$ increases.

For an Assel mill using three rollers circumferentially spaced apart at approximately 120° intervals, the length L of smoothing part 4 of each forming roller 1 is defined by the relationship:

$$L=Z\times 10.7\times f\times \eta$$

where:

Z=the number of rollers=3 f=the so-called overlap factor for the smoothing part length=1.15 to 1.50

$\eta$=the advance efficiency

Based on this relationship and using, by way of illustration, the factors f=1.15 and $\eta$=0.9, the smoothing part length L of forming roller 1 can be calculated:

$$L=3\times 10.7\times 1.15\times 0.9=33.22 \text{ mm}$$

For a tube diameter $\phi D$ of 100 mm, the tangent of the transport angle $\gamma$ is:

$$\tan\gamma=\frac{Z\cdot L}{D\cdot\pi\cdot\eta\cdot f}=\frac{99.66}{324.99}=0.3067$$

This corresponds to a transport angle $\gamma$ of 17°.

For a tube diameter $\phi D$ of 250 mm, the tangent of the transport angle $\gamma$ is:

$$\tan\gamma=\frac{Z\cdot L}{D\cdot\pi\cdot\eta\cdot f}=\frac{99.66}{812.48}=0.1222$$

This second example thus corresponds to a transport angle $\gamma$ of 7°.

If the number of forming rollers 1 is increased to four, by way of example, the transport angle $\gamma$ defines an upper adjustment limit for the rolling mill.

To adapt the angular velocity of a particular point on the rounding part 5 of the forming roller 1 and the tube 7 located opposite this point requires a large expansion angle $\alpha$ of approximately 7° to 30°. At the same time, a short and rapidly opening rounding part 5 of forming roller 1 is provided. An opening angle $\beta$ of approximately 2° to 3° is known and the opening angle $\beta$ increases as the transport angle $\gamma$ increases. It has been found that an opening angle $\beta$ of at least approximately 4° improves the rounding of the tube 7 exiting from the smoothing part and thus prevents triangulation of the rear end of the tube. The preferred angular range for the opening angle $\beta$ in accordance with the invention is therefore approximately 4° to 15°.

In operation, a hollow ingot 6 is grasped in the conical entrance 2, placed into rotation, and drawn into the rollers 1 in the movement or advancement direction X (FIG. 1). The working shoulder 3 contacts the outer surface 9 of the ingot 6 while, at the same time, the mandrel 8 contacts the inner surface 10 of ingot 6. The outer and inner diameters of the ingot 6 are thereby reduced to such an extent that the ingot 6 touches the mandrel bar 8 with its inner surface 10 located under the forming rollers 1. The resulting wall thickness reduction is essentially carried out only under the working shoulder 3 while the smoothing part 4 serves to even out the wall thickness of the tube 7 being rolled from the ingot 6. During rolling under the working shoulder 3 and in the smoothing part 4, the tube is broadened and initially takes on a somewhat triangular cross-section at the forming rollers 1 as the tube wall curves into the spaces located between the forming rollers. The rounding part 5 eliminates the initially triangular cross-section of the tube 7.

Using a calibration and orientation method in accordance with the present invention, it is possible to produce surprisingly good thin-walled tubes at relatively high rolling speeds, so that the capacity and efficiency of rolling thin-walled tubes using the Assel method is increased and, in addition, the required tolerance values are achieved.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of calibrating a generally conical forming roller of an Assel-type mill for rolling tubes about a mandrel rotatable about a mandrel axis, the mill having at least three said forming rollers circumferentially spaced about the mandrel, each said forming roller including a conical entrance, a working shoulder, a smoothing part and a rounding part, and being operatively rotatable about a forming roller axis oriented relative to the mandrel axis by a first angle $\alpha$, each said forming roller being further oriented relative to the mandrel axis by a second angle $\gamma$ defined between the mandrel axis and said forming roller axis, comprising the steps of:

(a) adjusting the second angle $\gamma$ of each forming roller to be approximately in the range 7° to 17°, said adjustment depending on the rolling tube diameter and the length of the smoothing part of each roller, said second angle $\gamma$ decreasing with increasing tube diameters;

(b) adjusting the first angle $\alpha$ of each forming roller to be approximately in the range 7° to 30°; and (c) providing an orientational relationship between the rounding part and the smoothing part of each forming roller defined by a third angle $\beta$ in the range of approximately 4° to 15° and defined between the mantle extension of the rounding part of the forming roller and a mantle extension defined along a circumferential periphery of the forming roller smoothing part.

* * * * *